US006306196B1

(12) United States Patent
Date et al.

(10) Patent No.: US 6,306,196 B1
(45) Date of Patent: Oct. 23, 2001

(54) SINTERED TI-SYSTEM MATERIAL PRODUCT DERIVED FROM INJECTION MOLDING OF POWDER MATERIAL AND PRODUCING METHOD THEREOF

(75) Inventors: Kenji Date, Matsue; Yutaka Kubo, Narita; Yoshifumi Morimoto, Matsue, all of (JP)

(73) Assignees: Hitachi Metals, Ltd., Tokyo; HMY, Ltd., Shimane-ken (JP)

( * ) Notice: Subject to any disclaimer, the term of this patent is extended or adjusted under 35 U.S.C. 154(b) by 0 days.

(21) Appl. No.: 09/633,342

(22) Filed: Aug. 4, 2000

(30) Foreign Application Priority Data

Aug. 4, 1999 (JP) ..... 11-221794

(51) Int. Cl.[7] ..... B22F 3/24

(52) U.S. Cl. ..... 75/245; 75/236; 75/243; 428/547; 449/14; 449/29

(58) Field of Search ..... 75/236, 243, 245; 419/14, 29; 148/669, 514; 428/547

(56) References Cited

U.S. PATENT DOCUMENTS 3,802,939 * 4/1974 Ohtani et al. .
3,841,848 * 10/1974 Kasai .
4,606,767 * 8/1986 Nagato ..... 75/242
5,403,374 * 4/1995 Kitagawa et al. ..... 75/238
5,403,411 * 4/1995 Smith et al. ..... 148/514
5,441,695 * 8/1995 Gladden ..... 419/37
5,545,248 * 8/1996 Tokumoto et al. ..... 75/238
6,027,686 * 2/2000 Takahashi et al. ..... 419/38

FOREIGN PATENT DOCUMENTS 7-62466 3/1995 (JP) ..... C22C/1/04
7-90318 4/1995 (JP) ..... B22F/3/10
9-13153 1/1997 (JP) ..... C22F/1/18

OTHER PUBLICATIONS

Patent Abstract of Japan 07062466 Mar. 7, 1995.
Patent Abstract of Japan 09013153 Jan. 14, 1997.
Patent Abstract of Japan 07090318 Apr. 4, 1995.

* cited by examiner

*Primary Examiner*—Ngoclan Mai
(74) *Attorney, Agent, or Firm*—Sughrue, Mion, Zinn, Macpeak & Seas, PLLC

(57) ABSTRACT

Disclosed is a sintered Ti-based material product derived from injection molding of a powder material. The outer layer region of the product comprises a lower amount of carbon than the inner layer region of the same. The inner layer region comprises a Ti-based carbide which has an average grain size of not less than 1 $\mu$m and which is dispersed in the inner structure to have an area fraction of not less than 0.1% to not more than 20%. The outer layer region comprises a lower amount of Ti-based carbide than the inner layer region. There can be observed an area fraction of less than 0.1% of the Ti-based carbide at the surface of the sintered Ti-based material product.

8 Claims, 7 Drawing Sheets

| HEAT TREATMENT TEMPERATURE | SECTIONAL STRUCTURE FROM SURFACE TO INNER LAYER REGION | THICKNESS OF OUTER LAYER REGION |
|---|---|---|
| BEFORE HEAT TREATMENT (AS SINTERED AT 1300°C) |  | 0mm |
| 1350°C |  | 0.09mm |
| 1375°C |  | 0.15mm |
| 1400°C |  | 0.20mm |

100μm

| HEAT TREATMENT TEMPERATURE | SURFACE FINISHED BY MIRROR-POLISHING | MIRROR APPEARANCE | PORE(AREA FRACTION %) | Ti-TYPE CARBIDE (AREA FRACTION %) |
|---|---|---|---|---|
| BEFORE HEAT TREATMENT (AS SINTERED AT 1300°C) |  | POOR | 1.7 | 15 |
| 1350°C |  | RATHER GOOD | 1.9 | 0.06 |
| 1375°C |  | GOOD | 0.4 | GENERALLY NOTHING |
| 1400°C |  | VERY GOOD | 0.1 | GENERALLY NOTHING |

200μm

| | FORM OF CARBIDE | AREA FRACTION OF CARBIDE | AVERAGE GRAIN SIZE |
|---|---|---|---|
| OUTER LAYER REGION |  | 0.03% | 5.0μm |
| BOUNDARY REGION |  | 17.4% | 16.7μm |
| INNER LAYER REGION |  | 2.07% | 6.5μm |

50μm

| SINTERING TEMPERATURE | SECTIONAL STRUCTURE FROM SURFACE TO INNER LAYER REGION |
|---|---|
| PRODUCT SINTERED AT 1375°C |  |
| SINTERED PRODUCT HEAT-TREATED AT 1450°C |  |

100μm

SINTERED TI-SYSTEM MATERIAL PRODUCT DERIVED FROM INJECTION MOLDING OF POWDER MATERIAL AND PRODUCING METHOD THEREOF

BACKGROUND OF THE INVENTION

The present invention relates to a sintered Ti-based material product derived from injection molding of a powder material and a producing method thereof, in which the product can be provided with a mirror surface without any cloud by a finish machining of mirror-polishing.

Conventionally, a Ti-based alloy material required to have a mirror appearance has been used for exterior components of clocks or watches, for example. These components have been provided primarily by hot forging and machining of a material derived from the melting and casting process. But, those produced by the conventional method are inferior in the degree of freedom when designing since the forging is unsuitable for producing a product having a complicated form, and also be inferior in anti-scratch property since they must be provided with a limited low hardness for ensuring easy machining. Further, because they need a finishing allowance, the machining cost is expensive.

On the other hand, there has been known the metal powder injection molding (usually called "MIM") which is a method of producing a sintered body. The method comprises the steps of deforming feedstock by an injection molding machine, the feedstock consisting of a kneaded mixture of a metal powder and an organic binder; preparing a debinded body (brown body) by eliminating the binder from the molded body (green body) by means of an organic solvent or heating (herein below, this step is referred to as "a debinding process"); and heating the debinded body at a high temperature to obtain a sintered body.

The MIM is an excellent mass-production method of a three dimensional complicated form body made of a tough working material such as a Ti-based alloy. There is proposed in JP-A-7-90318 to produce a sintered Ti-based material product.

However, it has been impossible to provide excellent mirror surface to the conventional sintered Ti-based sintered MIM material because a white cloud can not be avoided even after finish mirror-polishing. While there are exterior components of watches as well as a watch frame, which are included in an item that is strictly required to have a mirror surface, until now there has not appeared the exterior components of watches made of the sintered Ti-based sintered MIM material in the market as an alternative of forged products.

BRIEF SUMMARY OF THE INVENTION

Accordingly, an object of the present invention is to provide a sintered Ti-based material product derived from injection molding of a powder material which can have a satisfactorily good mirror appearance to users and a producing method thereof, and a producing method thereof.

The present inventors found from examinations that one of causes, which degrade the mirror appearance of a sintered Ti-based material product derived from injection molding of a powder material, is a Ti-based carbide generated from carbon that is inevitably comprised as an impurity. In addition, as a result of further examinations, the inventors found a sintered Ti-based material product derived from injection molding of a powder material with a novel structure, which is prevented from degradation of mirror appearance due to the Ti-based carbide and suitable for mass production.

Thus, according to the present invention, there is provided a sintered Ti-based material product derived from injection molding of a powder material, wherein the outer layer region of the product comprises a lower amount of carbon than the inner layer region.

In the sintered Ti-based material product, preferably the inner layer region comprises a Ti-based carbide having an average grain size of not less than 1 $\mu$m and being dispersed in the inner structure at an area fraction of 0.1% to 20%, whereas the outer layer region comprises a relatively lower amount of the Ti-based carbide than the inner layer region.

Desirably, the present invention is applied to a sintered Ti-based material product derived from injection molding of a powder material which has a carbon amount of 0.2 mass % to 1.0 mass %.

Also desirably, in the invention product, a Ti-based carbide observed on the surface having an average grain size of not less than 1 $\mu$m is present at an area fraction of less than 0.1%.

More preferably, the outer layer region having a lower amount of Ti-based carbide than the inner layer region has a thickness of not less than 0.05 mm.

According to the invention, the surface hardness can be higher than the inner layer region by 15% or more.

The sintered Ti-based material product can be obtained by the producing method according to the invention which comprises any one of the following steps for decomposing a Ti-based carbide residing at the surface of the Ti-based material:

a) the Ti-based material is sintered at a temperature of not lower than 1350° C., and b) the Ti-based material is subjected to a heat treatment at a temperature of not lower than 1350° C. after sintering.

DETAILED DESCRIPTION OF THE PREFERRED EMBODIMENTS OF THE PRESENT INVENTION

Figure 1:
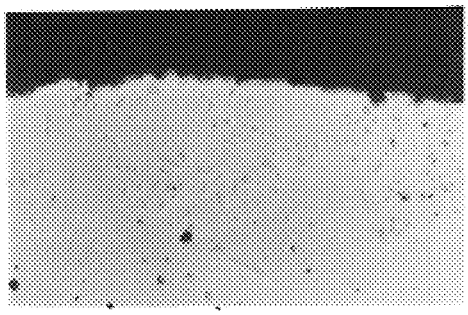
FIG. 1 is of photographs showing embodiment sectional metal microstructures of the invention and comparative examples.
Figure 1:
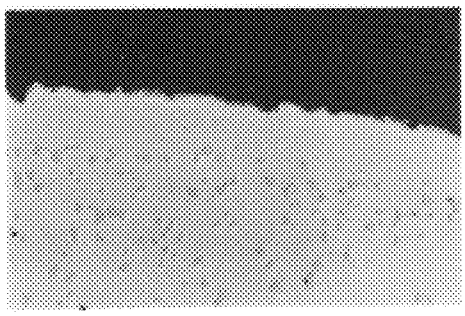
Figure 1:
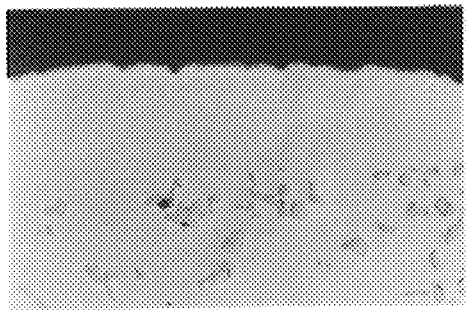
Figure 1:
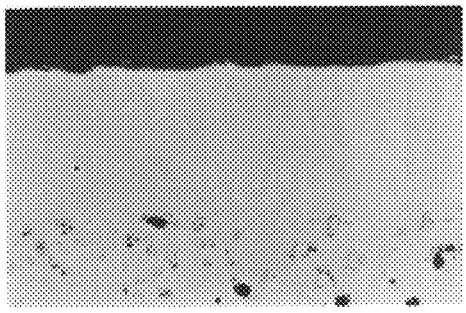

As described above, one of the key aspects of the invention is to form the outer layer region having a lower amount of carbon, namely a lower amount of a Ti-based carbide, than the inner layer region.

It is believed that a Ti-based carbide, which causes degradation of a mirror appearance, is generated during sintering by a reaction between a residual organic binder, remained in an injection-molded body in the debinding process which is one step of a conventional injection molding process, and a Ti-based alloy which is a base material.

In order to reduce the amount of the Ti-based carbide, it is considered that the debinding process of the production process employing an MIM method is strictly controlled so as not to allow an organic binder to remain in a debinded body. However, this inevitably requires a long-time debinding process, thereby increasing production costs disadvantageously.

It has been found from examinations made by the present inventors that the Ti-based carbide existing around the surface can be decomposed and diffused by heating. From this finding, the amount of the Ti-based carbide existing in the outer layer region, which affects the mirror appearance, can be reduced even if he carbon amount is high in the product, whereby a sintered Ti-based material product derived from injection molding of a powder material with an excellent mirror appearance has been attained.

There is mentioned above on a preferable structure of the sintered Ti-based material product of the invention that the inner layer region comprises a Ti-based carbide having an average grain size of not less than 1 $\mu$m and being dispersed in the inner structure at an area fraction of 0.1% to 20%. This is because, if the inner structure has an area fraction of less than 0.1% Ti-based carbide, it needs an increased cost for producing it and the advantageous effect of the invention is not significant, the advantageous effect being to obtain a mirror appearance by decreasing the amount of the Ti-based carbide existing in the outer layer region, since the Ti-based carbide is inherently comprised in a small amount of less than 0.1% area fraction.

On the other hand, in the case where the inner structure has an area fraction of more than 20% Ti-based carbide, although the advantageous effect, which is of improving a mirror appearance of the product by decreasing the amount of the Ti-based carbide existing in the outer layer region, can be obtained, the amount (an area fraction of more than 20%) of the Ti-based carbide is so large that it is difficult to obtain an outer layer region which is almost free of the Ti-based carbide for high-grade accessories such as components of watch or clock.

Desirably the invention sintered product as a whole comprises a carbon amount of 0.2 mass % to 1.0 mass %. A sintered product comprising a too low amount of carbon requires a too high production cost. On the other hand, in the case of a sintered product comprising an excessive amount of carbon, carbides are generated so much that, in order to obtain an excellent mirror appearance, the excessive carbide existing in the outer layer region must be considerably reduced thereby causing an increase of production cost.

In the present invention, there has been also found an effect of reducing the number of micro-pores on the surface by allowing carbon to be present when the Ti-based carbide is decomposed and diffused by heating. That is, in order to reduce the number of micro-pores, which are another cause of the degradation of a mirror appearance, it is preferable that a small amount of carbon be present.

Specifically, the sintered Ti-based material product derived from injection molding of a powder material with an excellent mirror appearance is desirably one in which a Ti-based carbide having an average grain size of not less than 1 $\mu$m and observed on the surface is dispersed at an area fraction of less than 0.1%, that is, one which has the Ti-based carbide on the surface as little as possible. Further, in consideration of the polishing process or the like, it is desirable that the thickness of the outer layer region having a lower amount of the Ti-based carbide than the inner layer region be set to be not less than 0.05 mm.

To obtain the above-described sintered Ti-based material product derived from injection molding of a powder material of the present invention, there can be used a method in which a Ti-based injection molded body is heated at a temperature of not lower than 1,350° C. to decompose a Ti-based carbide residing on its surface while or after the body is sintered.

More preferably, it is desirable to sinter a debinded body or sintered product having a carbon amount of 0.2 mass % to 1.0 mass % in a vacuum of less than 0.133 Pa. The sintering temperature is set at a temperature of not lower than 1,350° C. for the purpose of attaining an outer layer region structure with an excellent mirror appearance which can be obtained by decomposing a Ti-based carbide present at a sufficient depth within practical sintering time.

As the sintered Ti-based MIM product in the present invention, not only pure titanium but also titanium alloys such as Ti-6Al-4V, Ti-3Al-2V which is intended to decrease hardness for improving cutting properties, Ti-5Al-2.5Fe, Ti-8Al-1V and the like (numbers in these alloy names are represented in mass %) can be employed.

Further, when Al, which is a reinforcing element, is added, the concentration of the reinforcing element by the above heat treatment is observed on the surface, and a novel sintered product in which surface hardness is made higher than the hardness of the inner layer region by 15%. That is, a novel sintered product having both a mirror appearance and hardness can be provided.

EXAMPLES

A pure titanium powder (-45 $\mu$m) and a powder of 60Al-40V (-45 $\mu$m) were mixed together in a mass ratio of 95:5. The powder mixture and a thermoplastic organic binder were kneaded in a volume ratio of 6:4 to form into a feedstock, which was then molded by an injection molding machine. After the obtained molded body was debinded, the resulting debinded body was sintered in a vacuum of 0.133 Pa at 1,300° C. for 2.5 hours to prepare a sintered 3Al-2V-Ti alloy product (numbers are in mass %) having a carbon amount of 0.38 mass % as a whole.

Further, three sintered products were prepared by subjecting this sintered product to 2.5-hour heat treatment at 1,350° C., 1,375° C. and 1,400° C., respectively.

A photograph of a sectional metal microstructure, magnified a hundred times, of the obtained sintered product is shown in FIG. 1. As shown in FIG. 1, the sintered product prepared at 1,300° C. contains Ti-based carbides (granular structures observed therein) up very close to the surface and the outer layer region having a lower amount of Ti-based carbide than its inner layer region cannot be clearly seen.

On the other hand, in the case of the sintered product heated at a temperature of not less than 1,350° C., the outer layer region whose Ti-based carbide content has been clearly lowered can be seen.

Thereafter, all the above four sintered Ti-3A1-2V products were subjected to grinding using a #180 grinder to flat surfaces thereof and subsequently polished successively with a thread buff, a hemp buff and a cotton buff in this order.

The evaluation of the surfaces given a mirror-polishing finish was conducted visually.

Figure 2:
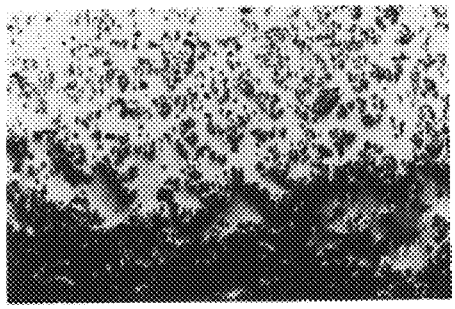
FIG. 2 is of photographs showing embodiment surface metal microstructures of the invention and comparative examples.
Figure 2:
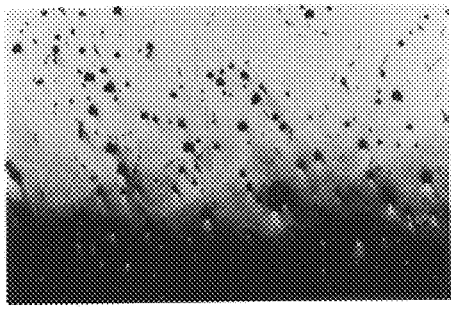
Figure 2:
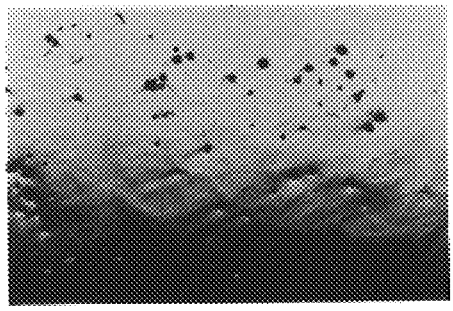
Figure 2:
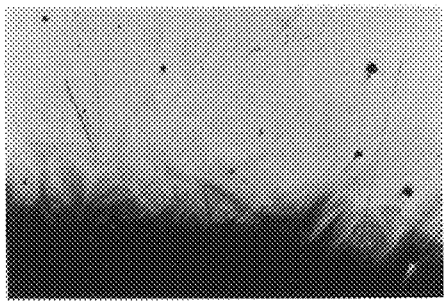

Relationships between the sintering temperatures and the states of the surfaces given a mirror-polishing finish are shown in FIG. 2.

On the surface given a mirror-polishing finish of the sintered product prepared at 1,300° C. and not yet subjected to heat treatment, there can be seen a number of protrusions of a Ti-based carbide and micro-pores, which cause the degradation of a mirror appearance.

Regarding the sintered products of the present invention which have been subjected to the heat treatment, on the other hand, it is observed that the number of protrusions due to a Ti-based carbide and micro-pores has been decreased according to a rise in the heat treatment temperature, which indicates an improvement in the mirror-polishing finished surfaces.

Figure 3:
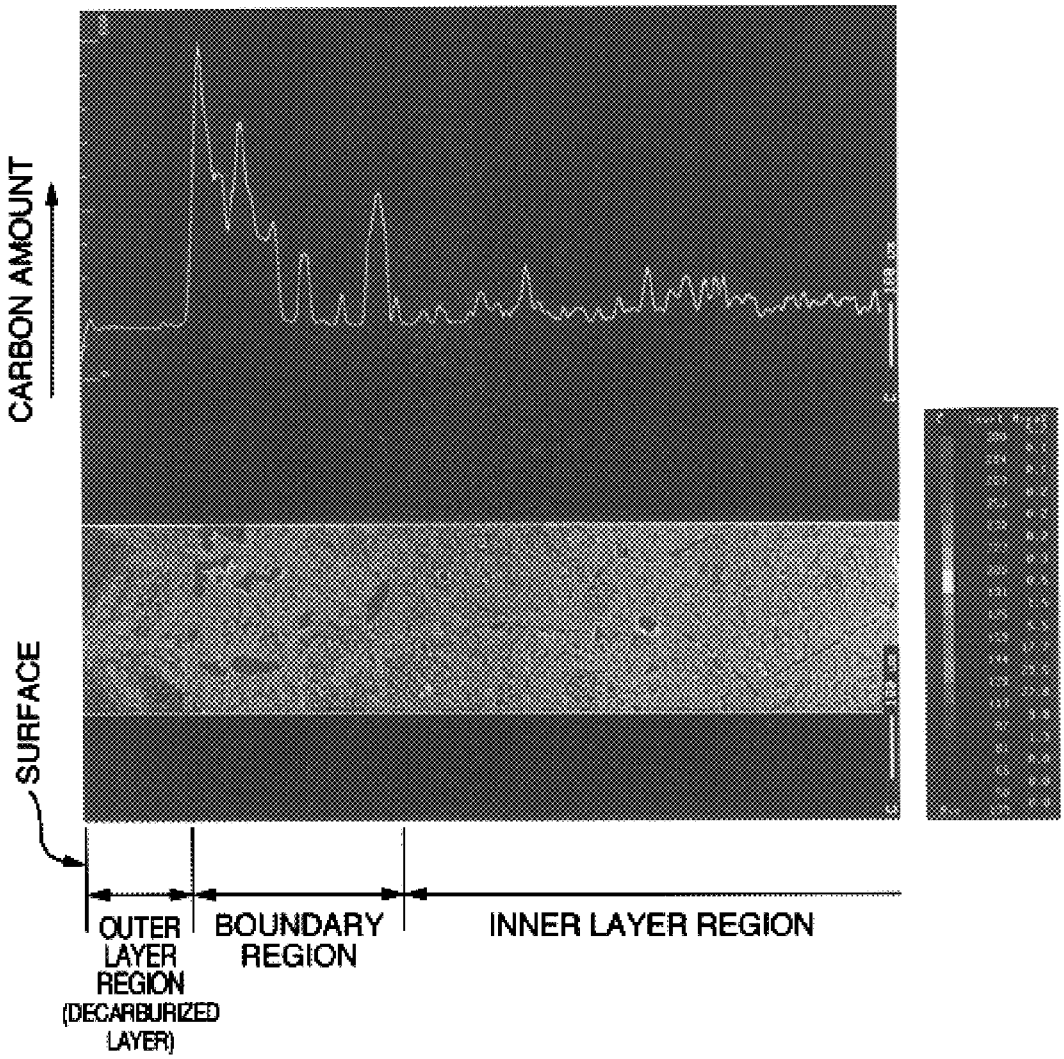
FIG. 3 is a photograph of a metal structure showing one example of carbon distribution in a section of the invention product.

FIG. 3 shows a distribution of carbon from the surface to the inner layer region of the sintered product heat-treated at 1,400° C. That is, it shows a linear analysis made on carbon using an EPMA and a carbon mapping on the corresponding positions.

The dark portions in the mapping that are seen in the form of a group of islands in the region deeper than the outer layer region are portions where carbon is concentrated. As a result of conducting a liner analysis so as to correspond to the mapping, it has been found that there clearly exists a portion (corresponding to 0.2 mm) where only little carbon exists in the outer layer region. It has also been found that there exists a boundary region of about 0.4 mm where carbon is concentrated in the region deeper than the outer layer region. From this finding, it is understood that carbon is diffused inwardly as well.

Figure 4:
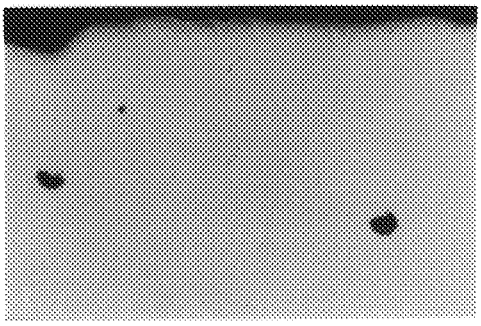
FIG. 4 is of photographs showing example forms of Ti-based carbides in the sectional metal microstructures of the invention.
Figure 4:
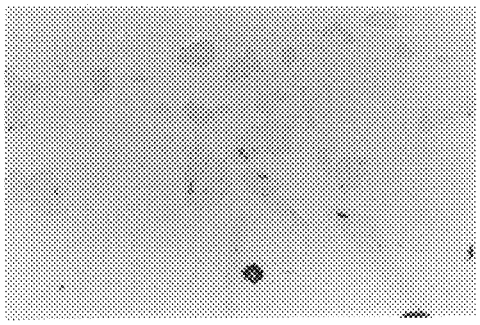
Figure 4:
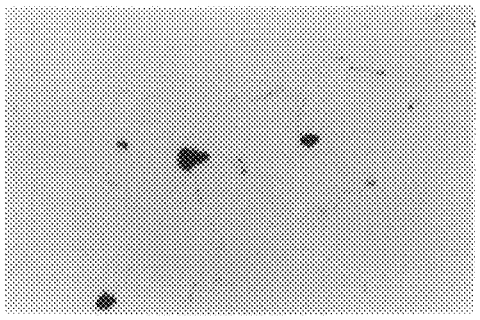

FIG. 4 shows the forms, area fractions and average grain sizes of carbides present in the outer layer region, boundary region and inner layer region of the sample shown in FIG. 3. It is shown that little carbide is seen in the outer layer region.

Figure 5:
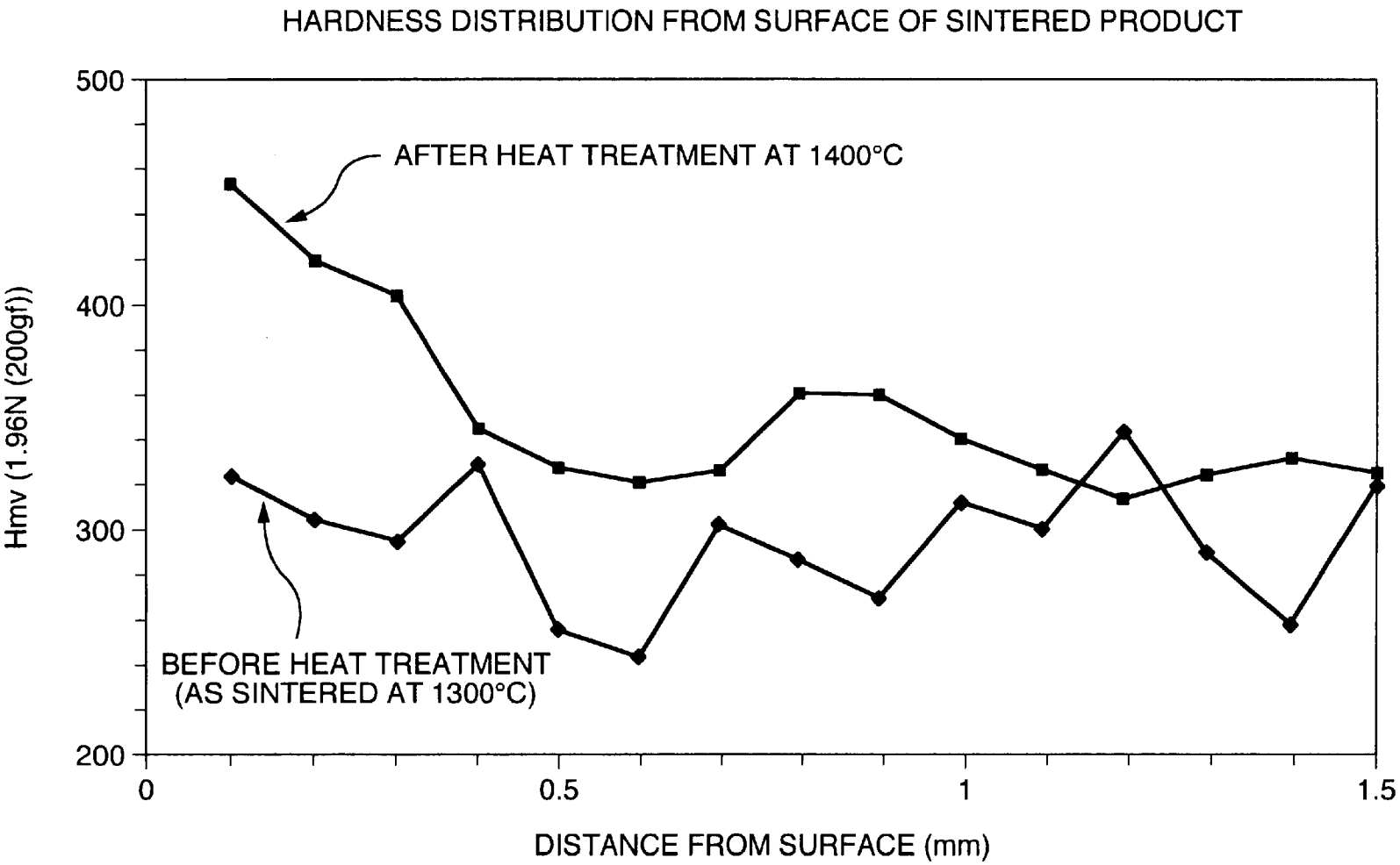
FIG. 5 is a graph showing one example of matrix-hardness distributions in the depth direction of the invention product and the conventional product which is not heat-treated.

FIG. 5 shows the result of studying the base hardness distribution from the surface of a sintered product prepared at 1,300° C. before and after it is subjected to heat treatment at 1,400° C. It is shown that the sintered body after the heat treatment has a great increase in hardness from its surface to a depth of 5 mm.

FIG. 6 shows the result of qualitatively conducting a liner analysis on the sectional microstructure ranging from the surface to the inner layer region of the sintered product heat-treated at 1,400° C. in FIG. 5 for each of Al, V and Ti elements using an EPMA, and the result of quantitatively conducting a spot analysis on the central portion of the decarburized layer (position at a depth of 0.1 mm from the surface) and the inner layer region (position at a depth of 1.0 mm from the surface).

Figure 6A:
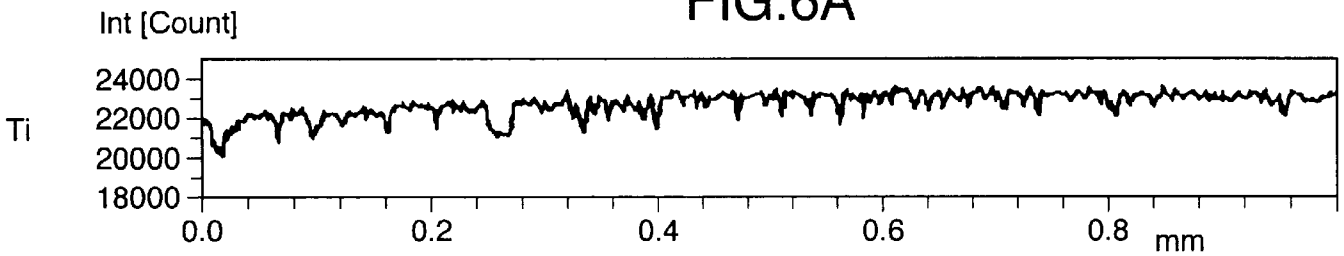
FIG. 6A shows one example of a concentration distribution of Ti in the depth direction of the invention product.
Figure 6B:
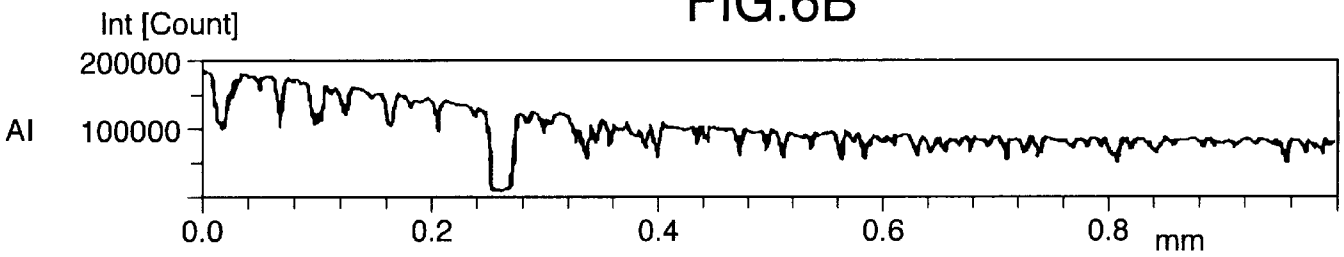
FIG. 6B shows one example of a concentration distribution of Al in the depth direction of the invention product.
Figure 6C:
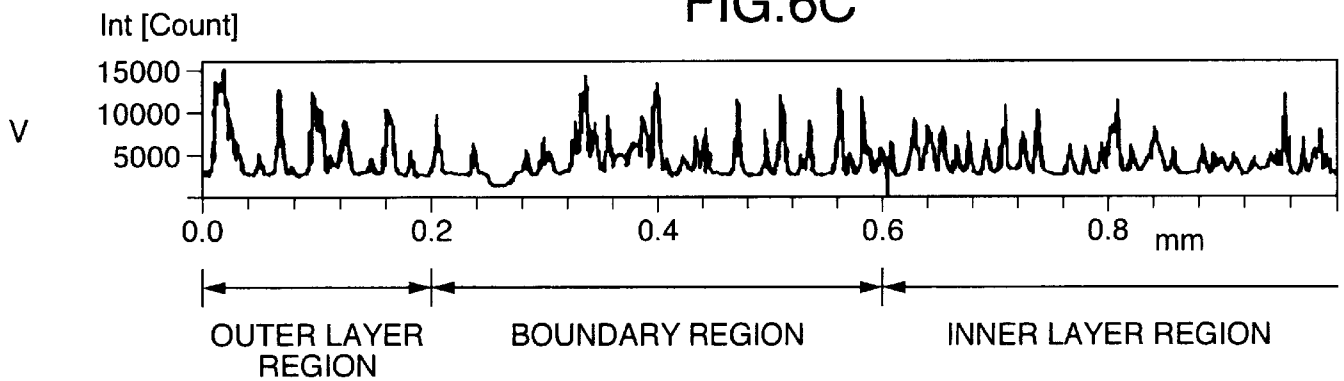
FIG. 6C shows one example of a concentration distribution of V in the depth direction of the invention product.

As shown in FIGS. 6A to 6C (see also Table 1), the concentration of Al increases from the inner layer region to the surface, and the concentration of Al in the outer layer region is about 2.7 times as high as that in the inner layer region. Since the tendency of Al concentration to increase from the inner layer region to the surface matches the tendency of increasing hardness, it is assumed that this increase in Al concentration causes an increase in hardness in the outer layer region.

TABLE 1

RESULTS OF QUANTITATIVE ANALYSIS OF Ti, Al AND V (BEAM DIAMETER: 100 μm)

| | OUTER LAYER REGION (0.1 mm FROM SURFACE) | INNER LAYER REGION (1.0 mm FROM SURFACE) |
|---|---|---|
| Ti | 88.2 mass % | 92.2 mass % |
| A1 | 7.2 mass % | 2.7 mass % |
| V | 1.7 mass % | 2.3 mass % |

It has been shown by FIGS. 5 and 6 that a sintered product having a hardened outer layer region can be obtained by applying the heat treatment according to the invention. It has also been shown that this can provide a sintered product with a hard outer layer region having both an excellent mirror appearance and excellent resistance to scratch.

Figure 7:
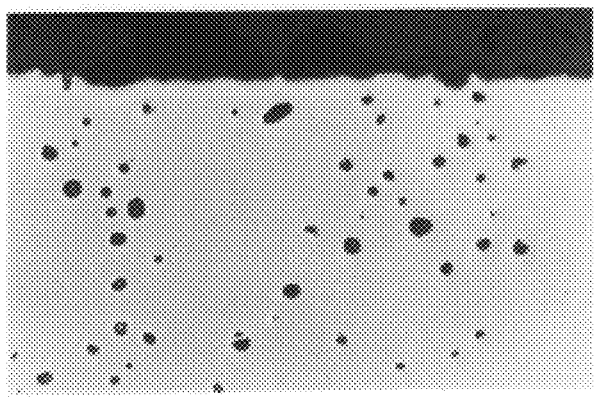
FIG. 7 is of photographs showing sectional metal microstructures of the comparative example comprising a low amount of carbon.
Figure 7:
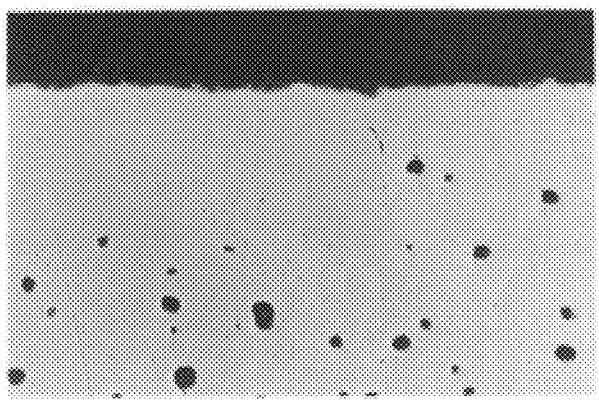

As a comparative example, a sintered product having a carbon amount of 0.07 mass % was prepared by sintering a Ti-3Al-2V molded body at 1,375° C. in the same manner as described above except that the molded body was debinded in an experimental reactor, which was not contaminated by organic matter generated by the decomposition of a binder, by halving the temperature rising rate used for the article of the invention and doubling the amount of time during which the molded body was maintained at the debinding temperature. This sintered product was further subjected to the heat treatment at a high temperature of 1,450° C. for 2.5 hours to prepare another sintered product. The sectional metal microstructures of these two sintered products are shown in FIG. 7. As shown in FIG. 7, since almost no carbide exists, distinct outer layer regions cannot be identified. In addition, unlike the above-described sintered product of the invention shown in FIG. 1, even after the high-temperature heat treatment, much more micro-pores remained on the surfaces of these sintered products than the surface of the sintered product of the invention. This shows that the presence of carbon causes a reduction in the number of micro-pores.

According to the present invention, a sintered Ti-based material product derived from injection molding of a powder material which contains little Ti-based carbide and only a small number of micro-pores in the proximity of its outer layer region can provide a dramatically improved mirror appearance.

Further, by using the sintered material of the invention, production costs can be lowered, a degree of flexibility in designing is increased, and an increase in hardness for improving resistance to scratch is made possible.

In addition, the sintered Ti-based material derived from injection molding of a powder material of the invention is expected to be applied to items requiring air tightness because its outer layer region contains only a small number of micro-pores and is dense accordingly.

What is claimed is:

1. A sintered Ti-base material product derived from injection molding of a powder material, wherein the outer layer region of the product comprises a lower amount of carbon than the inner layer region of the same.

2. A sintered Ti-base material product according to claim 1, wherein the inner layer region comprises a Ti-base carbide which has an average grain size of not less than 1 μm and which is dispersed in the inner structure to have an area fraction of not less than 0.1% to not more than 20%, whereas the outer layer region comprises a lower amount of Ti-base carbide than the inner layer region.

3. A sintered Ti-base material product according to claim 1, which comprises a carbon amount of not less than 0.2 mass % to not more than 1.0 mass %.

4. A sintered Ti-base material product according to claim 1, wherein there can be observed an area fraction of less than 0.1% of the Ti-base carbide, having an average grain size of not less than 1 μm, at the surface of the sintered Ti-base material product.

5. A sintered Ti-base material product according to claim 1, wherein the outer layer region, which comprises a lower amount of the Ti-base carbide than the inner layer region, has a layer thickness of not less than 0.05 mm.

6. A sintered Ti-base material product according to claim 1, wherein the surface hardness is higher by 15% than the inner layer region.

7. A sintered Ti-base material product derived from injection molding of a powder material, which comprises a carbon amount of not less than 0.2 mass % to not more than 1.0 mass %, wherein:

the outer layer region of the product comprises a lower amount of carbon than the inner layer region of the same;

the inner layer region comprises a Ti-base carbide which has an average grain size of not less than 1 μm and which is dispersed in the inner structure to have an area fraction of not less than 0.1% to not more than 20%, whereas the outer layer region, having a layer thickness of not less than 0.05 mm, comprises a lower amount of Ti-base carbide than the inner layer region;

there can be observed an area fraction of less than 0.1% of the Ti-base carbide, having an average grain size of not less than 1 m, at the surface of the sintered Ti-base material product; and the surface hardness is higher by 15% than the inner layer region.

8. A method of producing a sintered Ti-base material product by injection molding of a powder material and subsequent sintering, wherein the improvement comprises any one of the following steps for decomposing a Ti-base carbide residing at the surface of the Ti-base material:

a) sintering the Ti-base material at a temperature of not lower than 1350° C., and b) heat treating the Ti-base material at a temperature of not lower than 1350° C. after sintering.

* * * * *